US006923193B2

(12) United States Patent
Chen

(10) Patent No.: US 6,923,193 B2
(45) Date of Patent: Aug. 2, 2005

(54) OUTDOOR USED STAND FRAME OF AN UMBRELLA

(76) Inventor: Shiow-Hui Chen, 235 Chung-Ho Box 8-24, Taipei (TW)

( * ) Notice: Subject to any disclaimer, the term of this patent is extended or adjusted under 35 U.S.C. 154(b) by 219 days.

(21) Appl. No.: 10/601,916

(22) Filed: Jun. 24, 2003

(65) Prior Publication Data

US 2004/0261827 A1 Dec. 30, 2004

(51) Int. Cl.[7] ..... A45B 11/00
(52) U.S. Cl. ..... 135/20.1; 135/21
(58) Field of Search ..... 135/20.1, 20.3, 135/21, 98, 90, 16, 99

(56) References Cited

U.S. PATENT DOCUMENTS 5,735,302 A * 4/1998 Saliva ..... 135/20.1
5,785,069 A * 7/1998 Glatz ..... 135/20.1
5,937,882 A * 8/1999 Harbaugh ..... 135/20.3
6,014,980 A * 1/2000 Glatz ..... 135/20.1
6,196,242 B1 * 3/2001 Xu ..... 135/20.1
6,401,739 B1 * 6/2002 Bright et al. ..... 135/98
2002/0121297 A1 * 9/2002 Li et al. ..... 135/20.1
2005/0016571 A1 * 1/2005 Wu ..... 135/20.1

FOREIGN PATENT DOCUMENTS

DE 3307718 * 9/1984

* cited by examiner

*Primary Examiner*—Janet M. Wilkens

(57) ABSTRACT

A stand frame for an umbrella comprises a shaft, an umbrella frame, a foldable hanger arm hanging the umbrella frame, a height-adjustable device, and an angle-adjusting device. The stand frame for an umbrella utilizes the height-adjustable device and the angle-adjusting device to control the expansion/contraction and angular orientation of the umbrella frame thereof. The height-adjustable device provides a mechanism by which the middle section of the shaft can rotate horizontally, so as to move the umbrella frame about the shaft. A pull string extending from the shaft to the umbrella frame drives a vertical movement of the upper section of the shaft and the expansion of the umbrella frame simultaneously. A set of other pull strings are manipulated by the angle-adjusting device to vary the angular orientation of the umbrella frame in three dimensions.

18 Claims, 16 Drawing Sheets

OUTDOOR USED STAND FRAME OF AN UMBRELLA

FIELD OF THE INVENTION

The present invention relates to stand frames umbrellas, and more particularly to a stand frame for an umbrella that is used with outdoor facilities such as an outdoor coffee table. The stand frame for an umbrella can be mounted on a wall or independently erected, which provides control mechanisms for adjusting the expansion/contraction and the orientation of an umbrella thereof.

BACKGROUND OF THE INVENTION

The sun-shading umbrellas used on streets or in a café have large covering area. Due to the large surface and the thick frame of the umbrellas thereof, a distance between an umbrella erection site and a nearby wall is necessary for preventing contact therebetween. These sun-shading umbrellas therefore have to be mounted away from the wall and into a sidewalk, hindering people walking by. It is a further disadvantage that shopkeepers retrieving the umbrellas after business may also cause inconvenience to people walking by.

Moreover, the large sun-shading umbrellas of the prior art do not have a control device that adjusts the height and the expansion/contraction of the umbrellas simultaneously. Also, they do not have a control device that rotates the main shaft axially. It is a further disadvantage of the conventional sun-shading umbrellas that there does not exist a control device for adjusting the angular orientation of the umbrellas surface.

SUMMARY OF THE INVENTION

Accordingly, the present invention utilizes multi-sectional main shaft, wherein the upper section can move vertically along the axis and the middle section can rotate about the axis, by using a string and a height-adjustable device. An off-axis umbrella frame thereby rotates about the main shaft. The elevation of the upper section of the shaft is coupled with an extension of a hanger arm that hangs the umbrella frame, which, by another string, opens the umbrella frame simultaneously. Further, two other strings passing through the hanger arm by which an angle-adjusting device on the shaft can control the angular orientation of the umbrella frame.

To achieve above object, the present invention provide a stand frame for an umbrella comprising: a main shaft composed of an upper tube, a middle tube connected to the upper tube, a lower tube, and a connecting sleeve connecting the middle and the lower tubes; a stand base substantially mounted on a lower end of the lower tube; a top cover substantially mounted on an upper end of the upper tube; a height-adjustable device substantially mounted on the lower tube; a lower sleeve mounted on the upper tube and being capable of sliding thereon; a long hanger arm pivotally mounted on the lower sleeve; a short hanger arm with two ends respectively pivotally connected to the top cover and the long hanger arm; a fixing support including an L-shaped base section, a rotational section, and a connecting section; an axle passing through the rotational section and the connecting section; the connecting section being connected to the long hanger arm; an umbrella frame composed of an upper hinge disk, a lower hinge disk, a multi-sectional telescopic tube having two ends the upper hinge disk and the lower hinge disk being respectively mounted at, a plurality of main ribs each pivotally connected to the upper hinge disk and a plurality of connecting ribs each with one end pivotally connected to the lower hinge disk and with the other end connected to a main rib; an umbrella-opening string with one end tied to the top cover, passing around a pulley atop the umbrella frame, through a connecting column, and into the multi-sectional telescopic tube, and with the other tied to the lower hinge disk, an upper-tube-pulling string partially wound around a windlass in the height-adjustable device on the lower tube, passing around a pulley at an upper end of the middle tube and below a lower end of the upper tube, and being tied at a bottom of the upper tube; and a lower-sleeve-pulling string with one end tied to the lower sleeve, passing around a pulley atop the upper tube and entering the upper tube, and with the other tied at a top of the middle tube; a vertical movement of the upper tube driving a corresponding vertical movement of the lower hinge disk by the lower-sleeve-pulling string, causing the long hanger arm to extend or to contract, which makes the umbrella-opening string to open or to close the umbrella frame.

Furthermore the present invention provide a stand frame for an umbrella comprising a main shaft including an upper tube, a middle tube connected to the upper tube, a lower tube, and a connecting sleeve connecting the middle and the lower tubes; a stand base substantially mounted on a lower end of the lower tube; a top cover substantially mounted on an upper end of the upper tube; an angle-adjusting device mounted at the bottom of the upper tube; a lower sleeve mounted on a section of the upper tube between the top cover and angle-adjusting device; a long hanger arm pivotally mounted on the lower sleeve; a short hanger arm with two ends respectively pivotally connected to the top cover and the long hanger arm; a fixing support mounted at an end of the long hanger arm and including an L-shaped base section, a rotational section, and a connecting section; an axle passing through the rotational section and the connecting section; the connecting section being connected to the long hanger arm; an umbrella frame having an upper hinge disk, a lower hinge disk, a multi-sectional telescopic tube having two ends the upper hinge disk and the lower hinge disk being respectively mounted at, a plurality of main ribs each pivotally connected to the upper hinge disk and a plurality of connecting ribs each with one end pivotally connected to the lower hinge disk and with the other end connected to a main rib; a tilt-control string with one end wound around a first rotor in the angle-adjusting device and with another end passing around a pulley in the lower sleeve, entering the long hanger arm, extending to the rotational section of the fixing support, and being wound around a worm therein; the worm turns a semi-circular gear wheel mounted to the L-shaped base section to tilt the umbrella frame.

The various objects and advantages of the present invention will be more readily understood from the following detailed description when read in conjunction with the appended drawing.

BRIEF DESCRIPTION OF THE PREFERRED DRAWINGS

DETAIL DESCRIPTION OF THE PREFERRED EMBODIMENTS OF THE PRESENT INVENTION

A number of preferred embodiments according to the present invention are described as follows, in conjunction with the appended figures.

Figure 1:
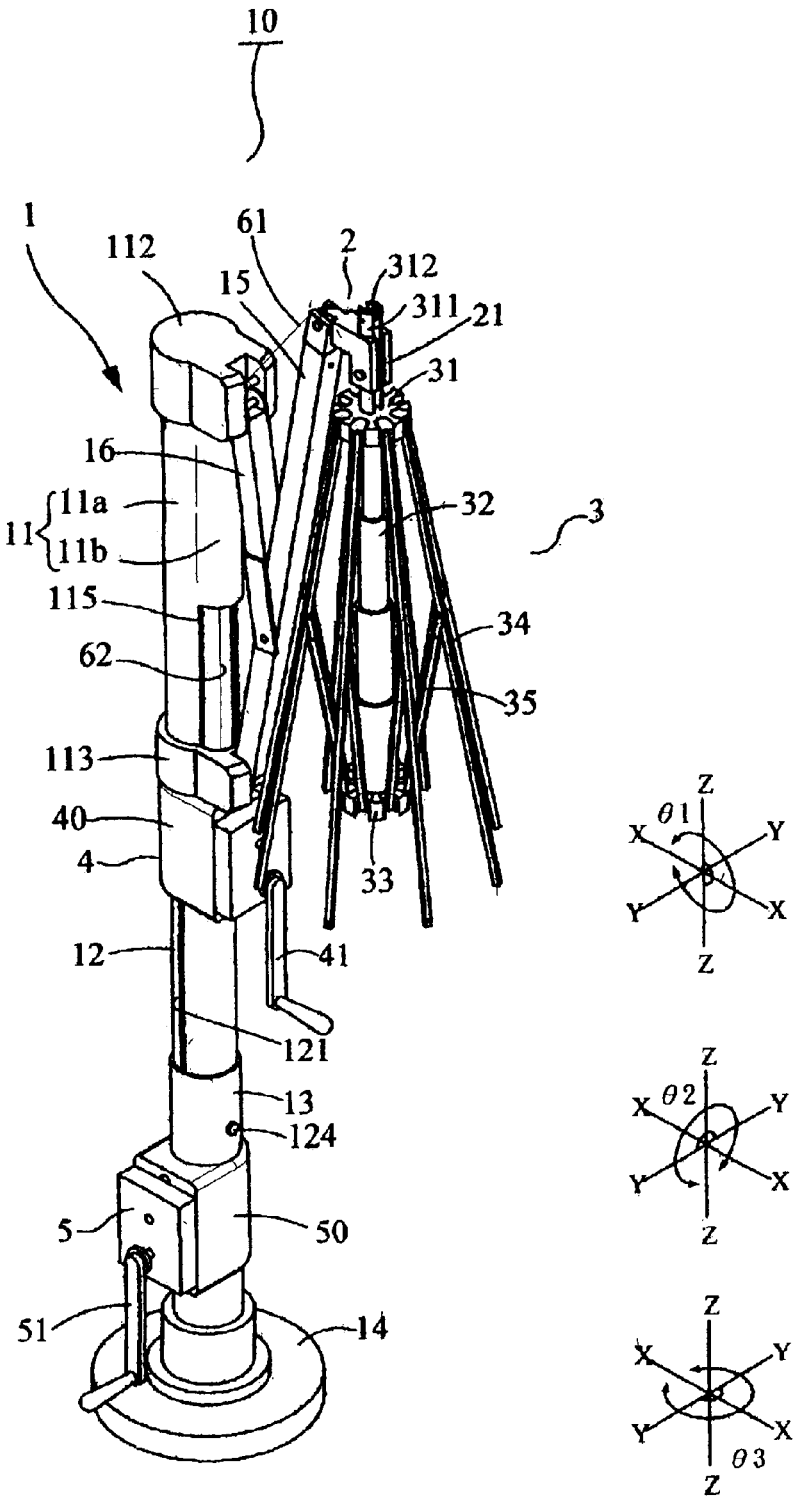
FIG. 1 is a perspective view of the present invention wherein the umbrella frame is in a contracted configuration.
Figure 2:
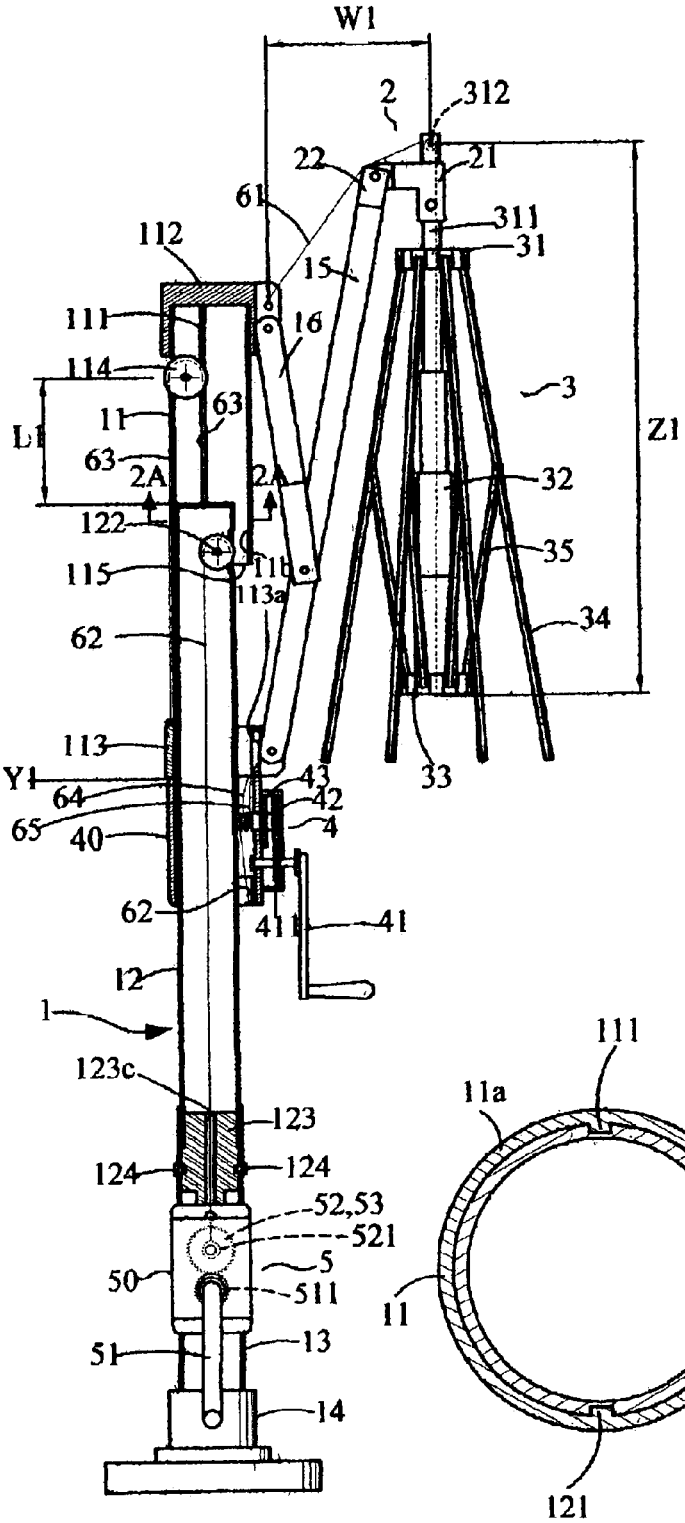
FIG. 2 is a cross-sectional side view of the present invention wherein the umbrella frame is in a contracted configuration.
Figure 2A:
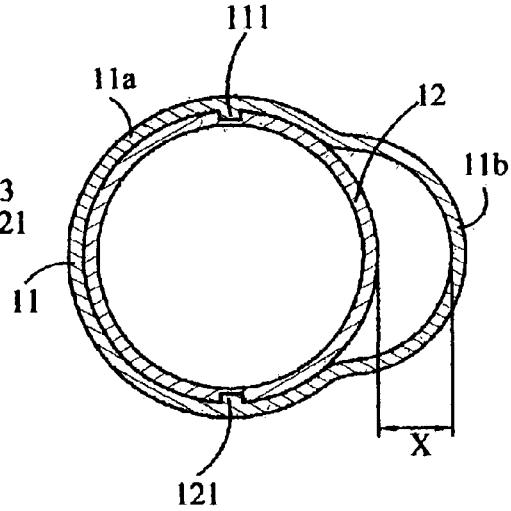
FIG. 2A is a cross-sectional view showing the connection of the upper tube and the middle tube.

The First Preferred Embodiment:

Referring to FIG. 1 and FIG. 2, the first preferred embodiment as a stand frame for an umbrella, according to the present invention, comprises a main shaft 1, a fixing support 2, an umbrella frame 3, an angle-adjusting device 4, and a height-adjustable device 5. The main shaft 1 is composed of an upper tube 11, a middle tube 12, a lower tube 13, a connecting sleeve 123, and a stand base 14. The upper tube 11 is mounted atop the middle tube 12 for connection. The lower tube 13 is mounted atop the middle tube 12 for connection. The lower tube 13, being inserted into a receiving chamber, is uprightly supported on the stand base 14. A top cover 112 is fixed at the top of the upper tube 11, and a lower sleeve 113 contains the upper tube 11, being capable of sliding thereon. The angle-adjusting device 4 is mounted on the lower end of the upper tube 11, and the height-adjustable device 5 is mounted on the lower tube 13 at a proper height. A long hanger arm 15 is extended from the lower sleeve 113, and a short hanger arm 16 is extended from the top cover 112 for pivotally jointing the long hanger arm 15 at a predetermined position thereon. The fixing support 2 is mounted on the extended end for hanging the umbrella frame 3. The strings 61, 62, 63, 64, and 55, as more clearly shown in FIG. 5, control the vertical movement of the upper tube 11 as well as the expansion/contraction of the umbrella frame 3; moreover, those strings can adjust the tilt angle θ1, the axial rotational angle θ2, and the horizontal angle θ3, as defiled in FIG. 1, to control the orientation of the umbrella frame 3 in three dimensions.

Figure 7:
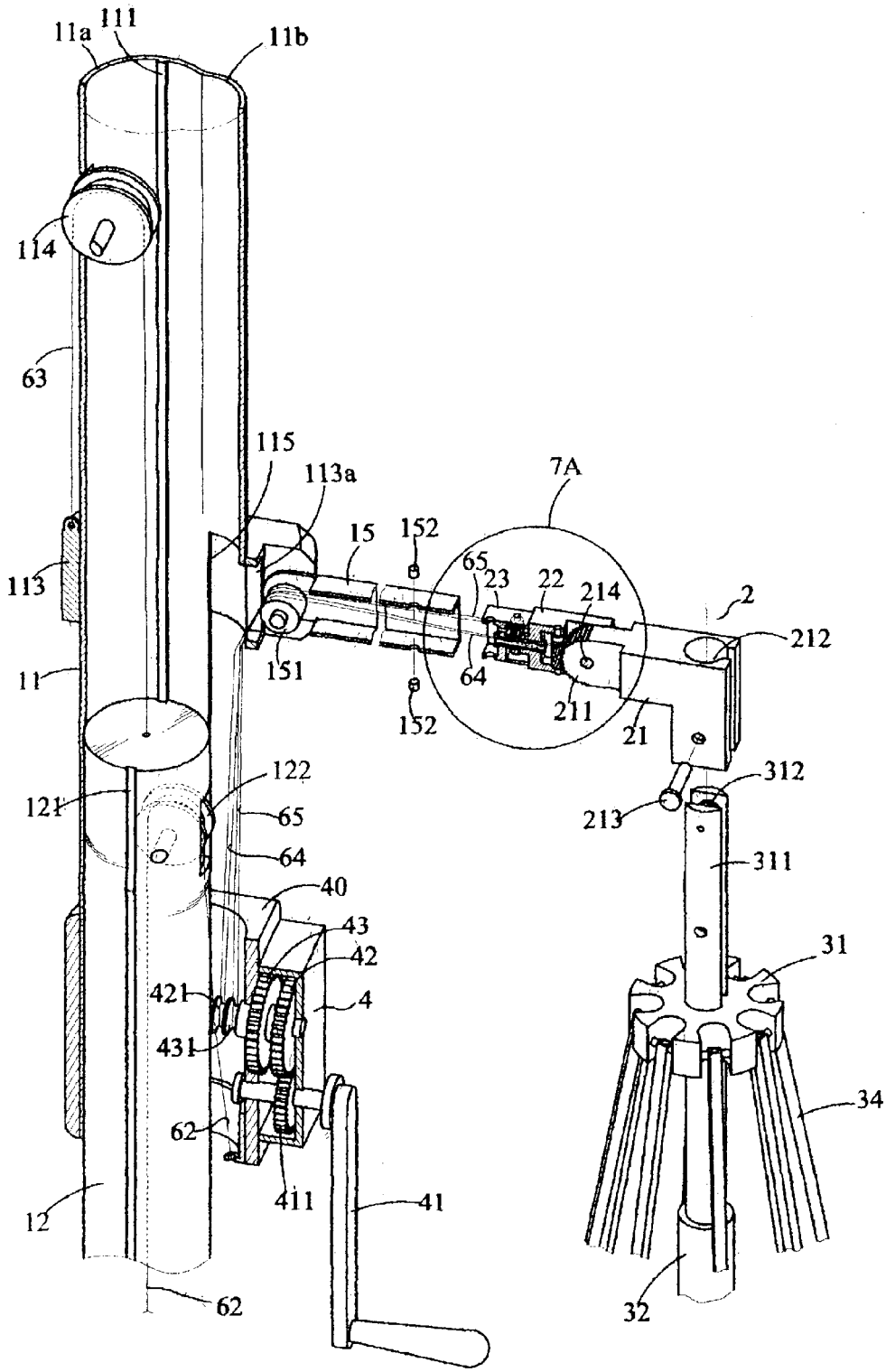
FIG. 7 is a cross-sectional view showing the connection of the long hanger arm and the fixing support.

The umbrella frame 3 is composed of an upper hinge disk 31, a lower hinge disk 33, a multi-sectional telescopic tube 32, a plurality of main ribs 34 and a plurality of connecting ribs 35. The upper hinge disk 31 and the lower hinge disk 33 are respectively mounted at the upper end and the lower end of the multi-sectional telescopic tube 32. The main ribs 34 are pivotally connected to the upper hinge disk 31 between teeth evenly formed on the circumference thereof. The connecting ribs 35 are pivotally connected to the lower hinge disk 33 between teeth evenly formed on the circumference thereof, extending outwardly to be connected with the main ribs 34. An L-shaped frame 21 receives a connecting column 311, which is attached to the multi-sectional telescopic tube 32 through the upper hinge disk 31, in a hole 212 therein, as shown in FIG. 7. A fixing pin 213 is inserted into a lateral hole on the L-shaped frame 21 to lock the umbrella frame 3 with the L-shaped frame 21.

The middle tube 12 is of circular cross-section, whereas cross-section of the upper tube 11 is composed of round portion 11*a* and bulged portion 11*b*. The middle tube 12 is closely surrounded by the round portion 11*a*, while maintaining a gap of a distance X with the bulged portion 11*b*. The gap is for receiving three strings 62, 64 and 65, as shown in FIG. 7. Further, a long opening 115 is formed on the lower part of the bulged portion 11*b* for facilitating the entrance of strings 64 and 65 into the bulged portion 11*b* and into an opening 113*a* within the lower sleeve 113. For guiding the upper tube 11 moving longitudinally along the middle tube 12 while preventing transverse relative rotation, two longitudinal fillisters are formed on the outer wall of middle tube 12 for receiving two corresponding strip bumps formed on the inner wall of the upper tube 11.

Figure 3:
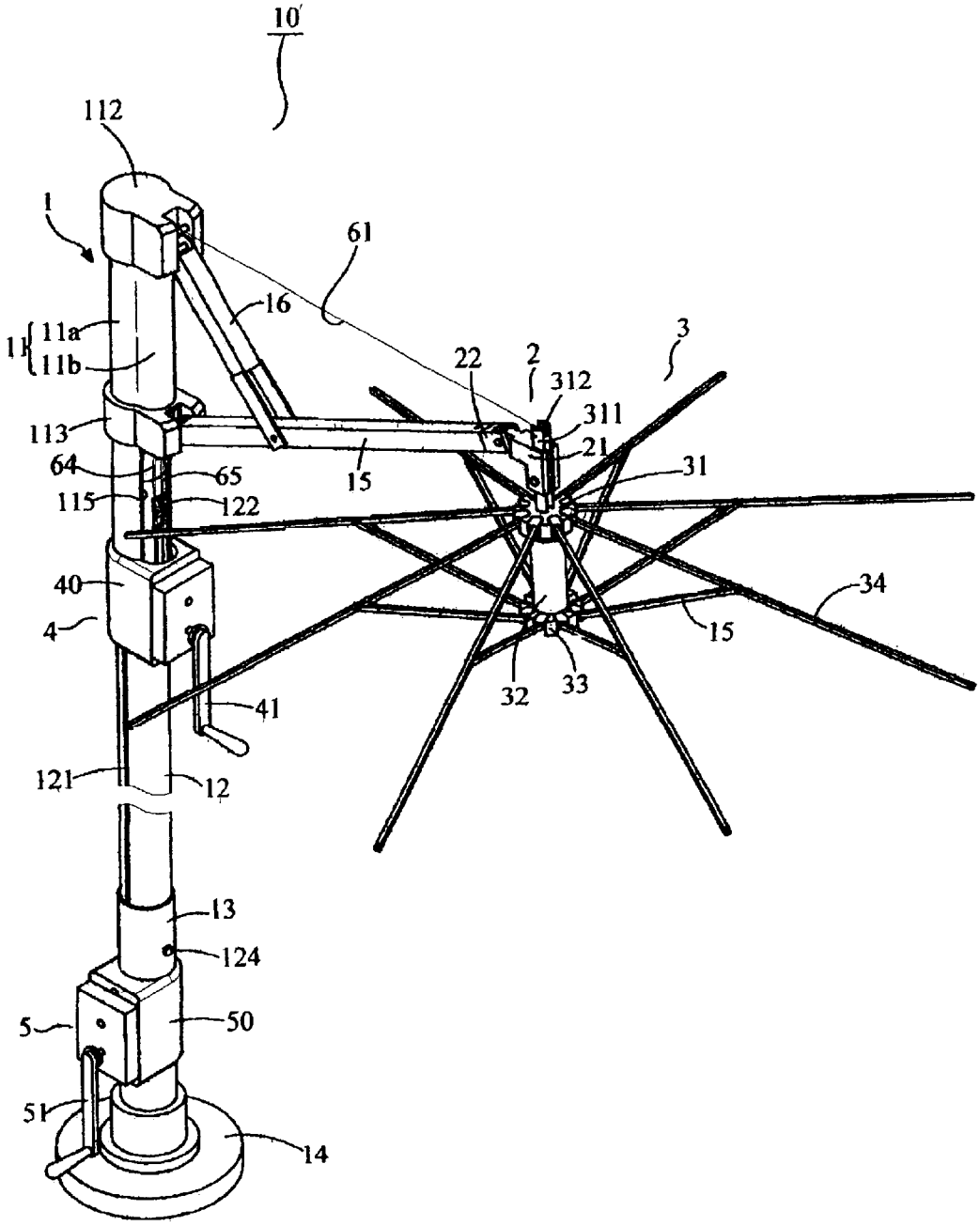
FIG. 3 is a perspective view of the present invention wherein the umbrella frame is in an expanded configuration.
Figure 4:
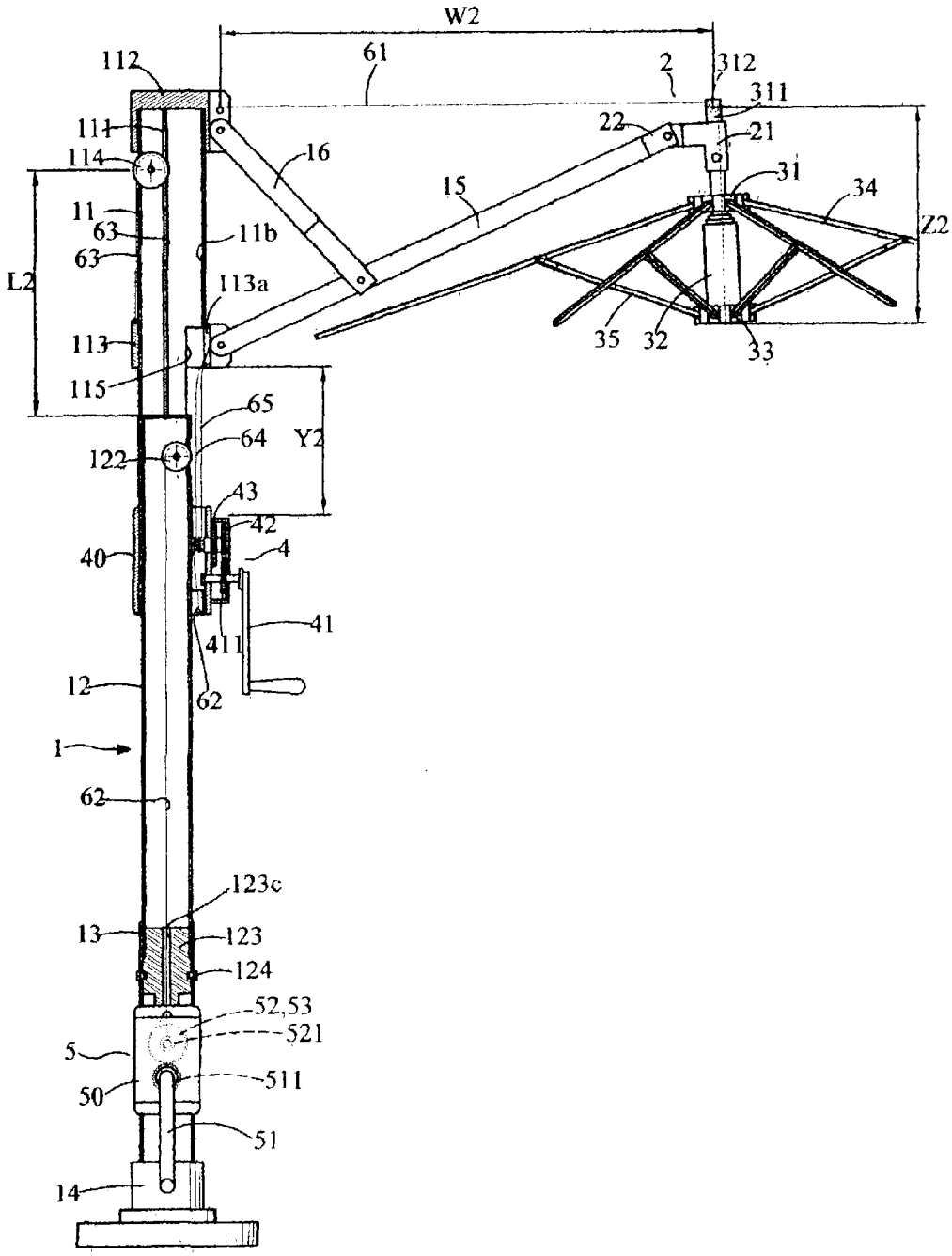
FIG. 4 is a cross-sectional side view of the present invention wherein the umbrella frame is in an expanded configuration.

The stand frame for an umbrella in which the umbrella frame 3 is in full expansion and the upper tube 11 is lifted is shown in FIG. 3 and FIG. 4. The string 61, with one end tied to the top cover 112, passes around a pulley 312 atop the umbrella frame 3, through the connecting column 311 and the multi-sectional telescopic tube 32, and connects the lower hinge disk 33. The sting 62, with one end tied to the windlass 521 in the height-adjustable device 5, passes through the middle tube 12 and around a pulley 122 at the upper end thereof, and goes but of the middle tube 12 to be tied on the bottom of the upper tube 11. The string 63 with one end tied to the lower sleeve 113, passes around a pulley 114 atop the upper tube 11, through the interior of the upper tube 11, and is tied on the top of the middle tube 12.

The umbrella frame 3 shown in FIG. 1 and FIG. 2 is in a contracted state, wherein the upper tube 11 and the angle-adjusting device 4 reside at the lower end of the middle tube 12, and both the long hanger arm 15 and the short hanger arm 16 are in an upright configuration. On the contrary, the upper tube 11 and the angle adjusting device 4 are in a higher position when the umbrella frame 3 is in an expanded state, as shown in FIG. 3 and FIG. 4. Since the middle tube 12 is connected through the connecting sleeve 123 with the lower tube 13 and locked by a fixing pin 124 thereon, no vertical movement of the middle tube 12 is allowed. Referring to FIG. 2, as the distance between the pulley 114 of the upper tube 14 and the top of the middle tube 12 is changing from L1 to L2, the string 63 keeps driving the lower sleeve 113 upward from Y1 to Y2 so as to shrink the distance between the lower sleeve 113 and the pulley 114. Moreover, as the lower sleeve 113 moves up, the long arm 15 tilts from a nearly vertical to a nearly horizontal configuration, and the fixing support 2 at the end of the long arm 15 moves outward, and thereby the distance between the connecting column 311 atop the umbrella frame 3 and the top cover 112 increases from W1 to W2. As the long hanger arm 15 extends outward, the string 61 slides around the pulley 312, and the distance between the lower hinge disk 33 and the pulley 312 decreases from Z1 to Z2, and thereby the multi-sectional telescopic tube 32 contracts upward. At the same time, the connecting ribs 35 pivoted oil the lower hinge disk 33 prop up the main ribs 34 to complete the action of opening the umbrella frame 3. The above process may go in a reverse way to close the umbrella frame 3

Figure 5:
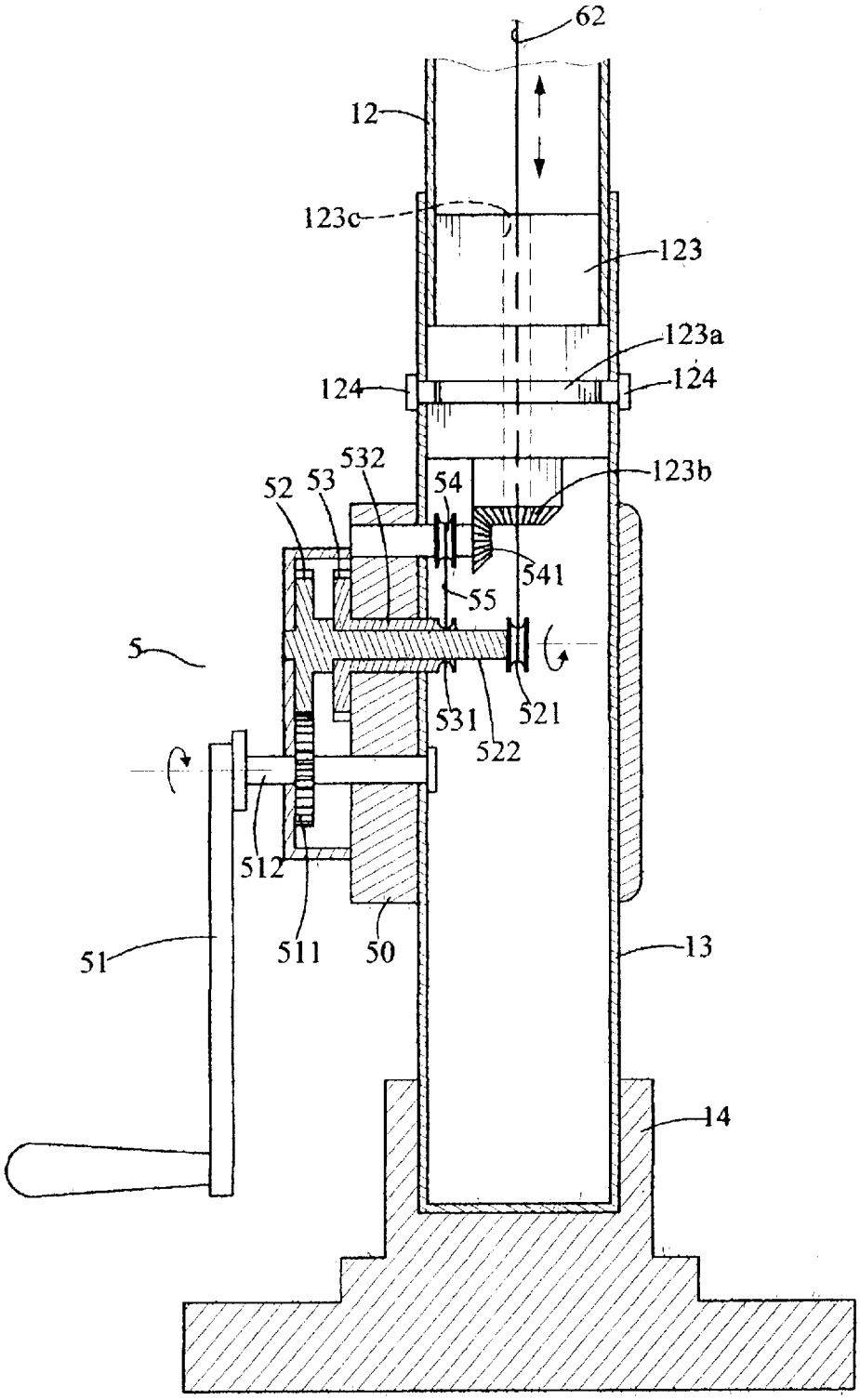
FIG. 5 is a side view of the present invention wherein the height-adjustable device drives a string to elevate the upper tube.

FIG. 5 illustrates the height-adjustable device 5 controlling the string 62. The vertical movement of the upper tube 11 is realized by the height-adjustable device 5, which comprises a base 50 mounted under the upper tube 11, a cranking bar 51 attached on the base 50, a gear wheel 511 being coaxial with the cranking bar 51, a gear wheel 52 engaged with the gear wheel 511, a gear wheel 53 being coaxial with the gear wheel 52, a windlass 521 being coaxial with the gear wheel 52, a rotor 531 being coaxial with and integrally connected to the gear wheel 53, a rotor 54 right above the rotor 531 with an axis parallel to that of the rotor 531, a gear wheel 541 being coaxial with the, rotor 54, and a string 55 encircling both the rotor 531 and the rotor 54. The gear wheel 511 and the cranking bar 51 rotate about a common, axis synchronously. The windlass 521 and the gear wheel 52 rotate about a common axis synchronously. The gear wheel 541 and the rotor 54 rotate about a common axis synchronously. The gear wheel 53 and the rotor 531 are two components sharing a common axis or are integrally formed on the same object. The gear wheel 52 and the gear wheel 53 rotate about a common axis and are parallel to each other a fixed distance apart. The rotational axis 522 of the gear wheel 52, passing through the tubular rotational axis 532 of the gear wheel 53, enters, the lower tube 13 for attaching the windlass 521. The cranking bar 51 is capable of moving along the axis thereof so as to select one of the gear wheel 52 and the gear wheel 53 to engage with the gear wheel 511. When the gear wheel 511 engages with the gear wheel 52, turning the cranking bar 51 enables a synchronous rotation of the windlass 521 for rolling up the string 62, by which the upper tube 11 is lifted up. Turning the cranking bar 51 the other way makes the windlass 521 to release the string 62, and the weight of the upper tube 11 and attached components thereof pulls the upper tube 11 downward and straightens the string 62. It should be noted that the string 62 always passes through a central hole 123*c* on the connecting sleeve 123.

Figure 6:
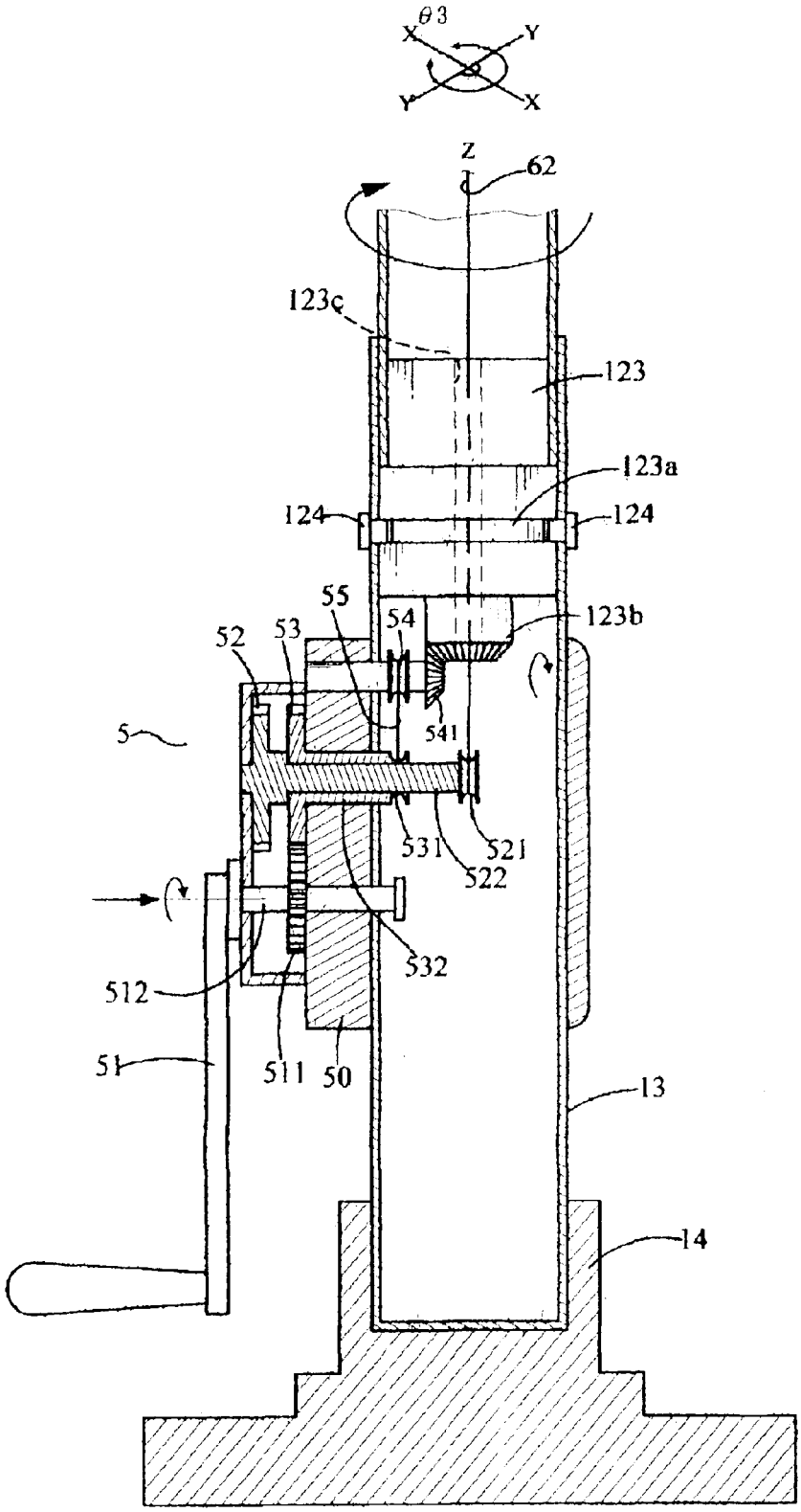
FIG. 6 is a side view of the present invention wherein the height-adjustable device controls the rotation of a connecting sleeve.

FIG. 5 illustrates the height-adjustable device 5 controlling the rotation of the connecting sleeve 123. The cranking bar 51 moves inward along the axis thereof so that the gear wheel 511 is engaged with the gear wheel 53. Turning the cranking bar 51 drives the rotor 531 and the rotor 54, coupled with the gear wheel 53 by the string 55, to rotate synchronously. The gear wheel 541, which is rotating with the rotor 54 synchronously, drives the connecting sleeve 123 to rotate through a gear wheel 123*b*. A ring fillister 123*a* is formed in a proper position of the 123 for receiving the fixing ring 124 atop the lower tube 13 so as to allow horizontal rotation of the connecting sleeve 123 within the lower tube 13 without coming off the lower tube 13. Since the middle tube 12 is substantially connected with the connecting sleeve 123, the connecting sleeve 123 forces the middle tube 12 to rotate accordingly. In other words, the umbrella frame 3 may adjust the horizontal angle θ3 by a relative rotation of the upper tube 11 and the middle tube 12 to the lower tube 13; the axis rotation is the Z axis in FIG. 6.

Figure 7A:
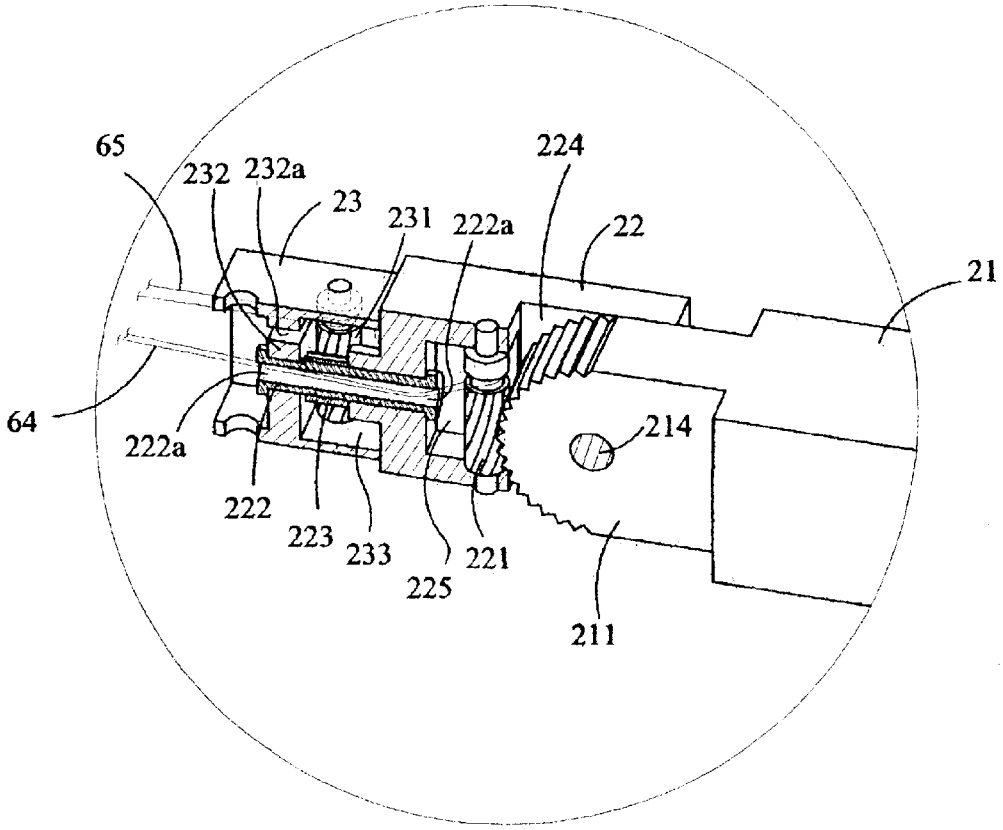
FIG. 7A is an enlarged cross-sectional view of the fixing support.

Referring to FIG. 7, which illustrates the combination of the fixing support 2 and the long hanger arm 15, the fixing support 2 comprises a base section 21, a rotational section 22, and a connecting section 23, wherein the connecting section 23 is mounted at the front end of the long hanger arm 15, locked by two fixing pins 152. Referring FIG. 7A, the connecting section 23 is divided by a connecting section 23 into two chambers. The front chamber 233 receives a gear wheel 223 attached at the rear end of the rotational section 22, wherein the gear wheel 223 is engaged with a worm 231 also contained in the front chamber 233. A string 65, partially wound around the worm 231, comes out of the front chamber 233 through a slot 232*a* in the block 232, enters into the long hanger arm 15, turns around at the pulley 151 into the hole 113*a* of the lower sleeve 113, and finally winds around a rotor 431 in the angle-adjusting device 4. To prevent the rotational section 22 from coming off the connecting section 23, an axle 222 is substantially inserted into a cavity 225 within the rotational section 22 through the block 232. The axle 222, being integrally connected to the gear wheel 223, rotates synchronously with the rotational section 22. Further, a worm 221 is mounted in the cavity 225 within the rotational section 22, which has the string 64 wound around and engaged with a first central hole 211 mounted in a U-shaped cavity 224 of the rotational section 22. The first central hole 211 is formed at one end of the base section 21 and pivotally mounted in the U-shaped cavity 224 by a bolt 214 so as to connect the base section 21 and the rotational section 22. The string 64 passes through an axial hole 222*a* within the axle 222, enters into the long hanger arm 15, turns around at the pulley 151 into the hole 113*a* of the lower sleeve 113, and finally winds around a rotor 421 in the angle-adjusting device 4.

Figure 8:
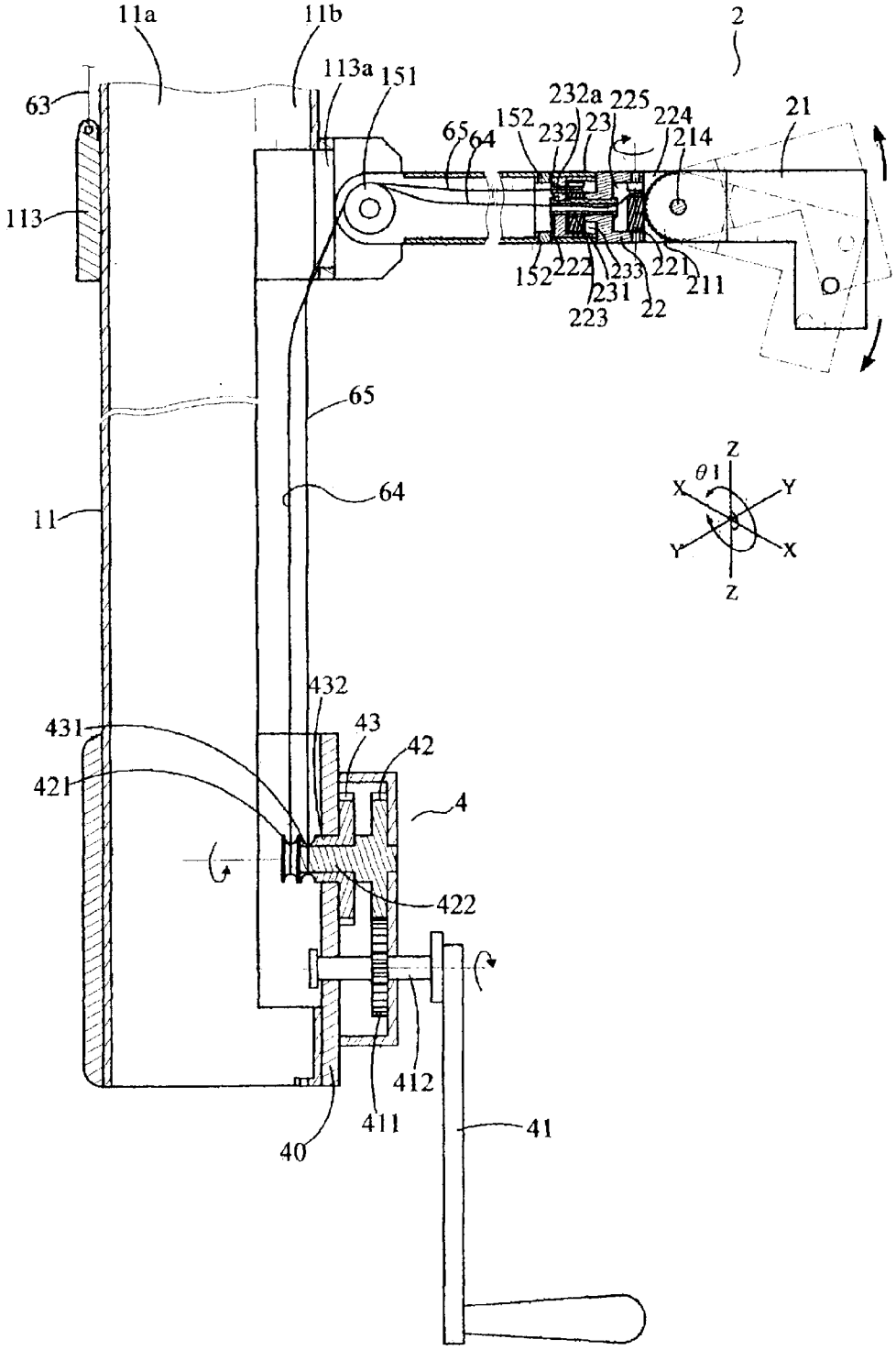
FIG. 8 is a cross-sectional view of the present invention wherein the angle-adjusting device controls the variation of the tilt angle of the umbrella frame.

FIG. 8 illustrates the 4 controlling the tilt angle of the 2. Referring to FIG. 8, the angle-adjusting device 4 comprises a base 40 mounted at the lower end of the upper tube 11, a cranking bar 41 extended from an outer wall of the base 40, a gear wheel 411 coaxial with the cranking bar 41, a gear wheel 42 engaged with the gear wheel 411 and having an axis above the gear wheel 411 and parallel to the axis thereof, a gear wheel 43 coaxial with the gear wheel 42, a rotor 421 substantially connected to the axis of the gear wheel 42, and a rotor 431 substantially connected to the axis of the gear wheel 43, wherein the gear wheel 411 rotates synchronously with the cranking bar 41, the rotor 421 rotates synchronously with the gear wheel 42, and the rotor 431 is integrally mounted on the gear wheel 43. Further, the gear wheel 42 and the gear wheel 43 are coaxial and separated by a fixed distance. The axis of the gear wheel 42, a solid cylinder, passes through the axis of the gear wheel 43, a hollow cylinder, and, enters into the upper tube 11 for attaching the rotor 421. Moreover, the cranking bar 41 can be shifted longitudinally so that the gear wheel 411 thereof can connect to either of the gear wheel 42 and the gear wheel 43. When the gear wheel 411 is engaged with the gear wheel 42, an operator can turn the cranking bar 41 so that, the rotor 421 rolls up the string 64, which drives the worm 221 in the fixing support 2 to rotate. The worm 221 then drives the semi-circular gear wheel 211 to rotate, by which the base section 21 spins about the bolt 214 so as to change the tilt angle θ1 defined in FIG. 8; the axial direction associated with the tilt angle θ1 is the Y axis in FIG. 8.

Figure 9:
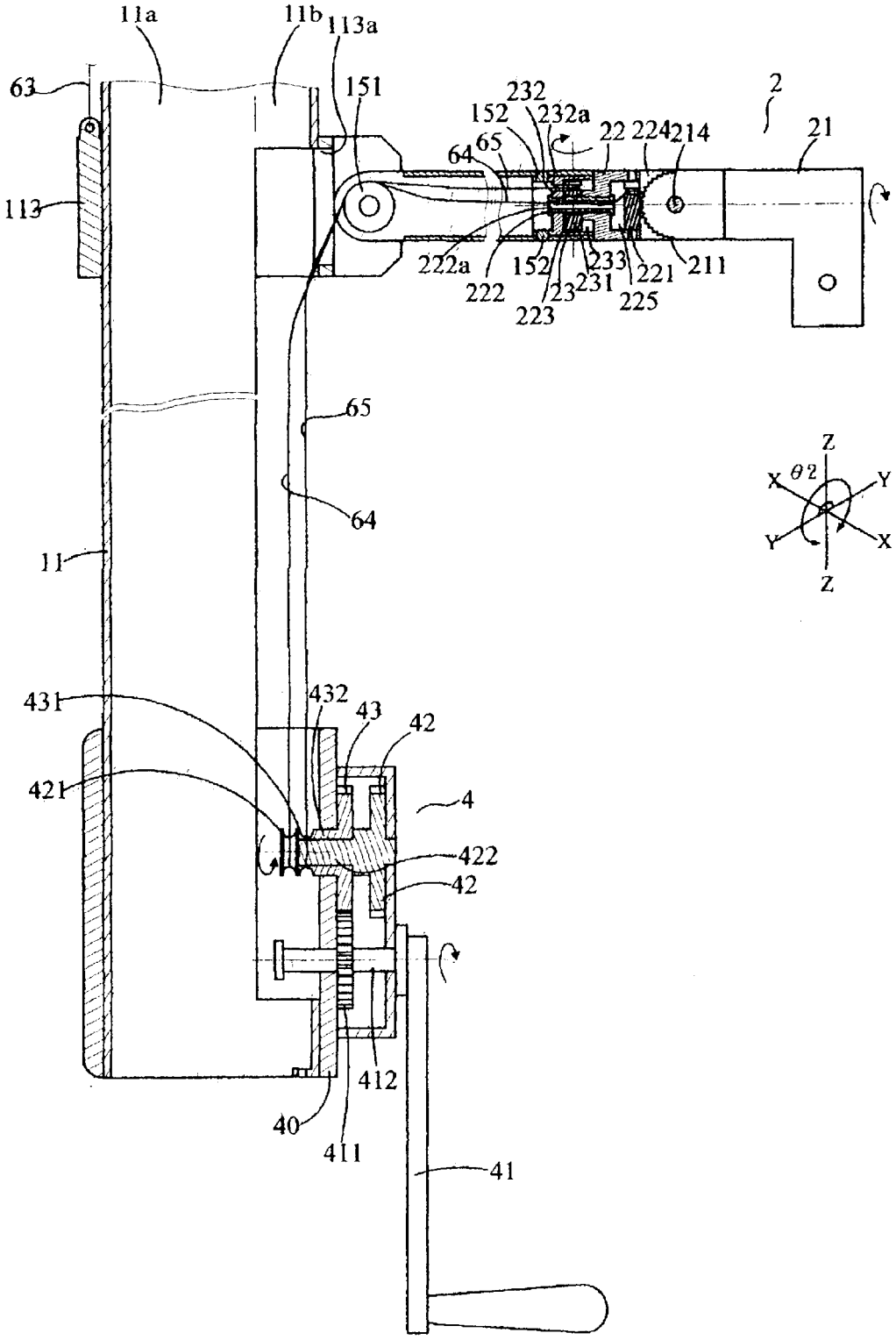
FIG. 9 is a cross-sectional view of the present invention wherein the angle-adjusting device controls the variation of the axial rotational angle of the umbrella frame.

FIG. 9 illustrates the angle-adjusting device 4 controlling orientation of the fixing support 2. Referring to FIG. 9, when the rotational axis of the cranking bar 41 shifts inward and the gear wheel 411 thereof becomes engaged with the gear wheel 43, turning the cranking bar 41 drives the rotor 431 to rotate, so as to pull the string 65. The string 65 then drives the worm 231 to rotate, and the worm 231 then turns the gear wheel 223, achieving a rotation of the rotational section 22 and the base section 21 pivotally connected to the rotational section 22 about the axle 222. The rotation produces an axial rotational angle θ2, defined in FIG. 9; the rotational axis is the X axis in FIG. 9.

Figure 10:
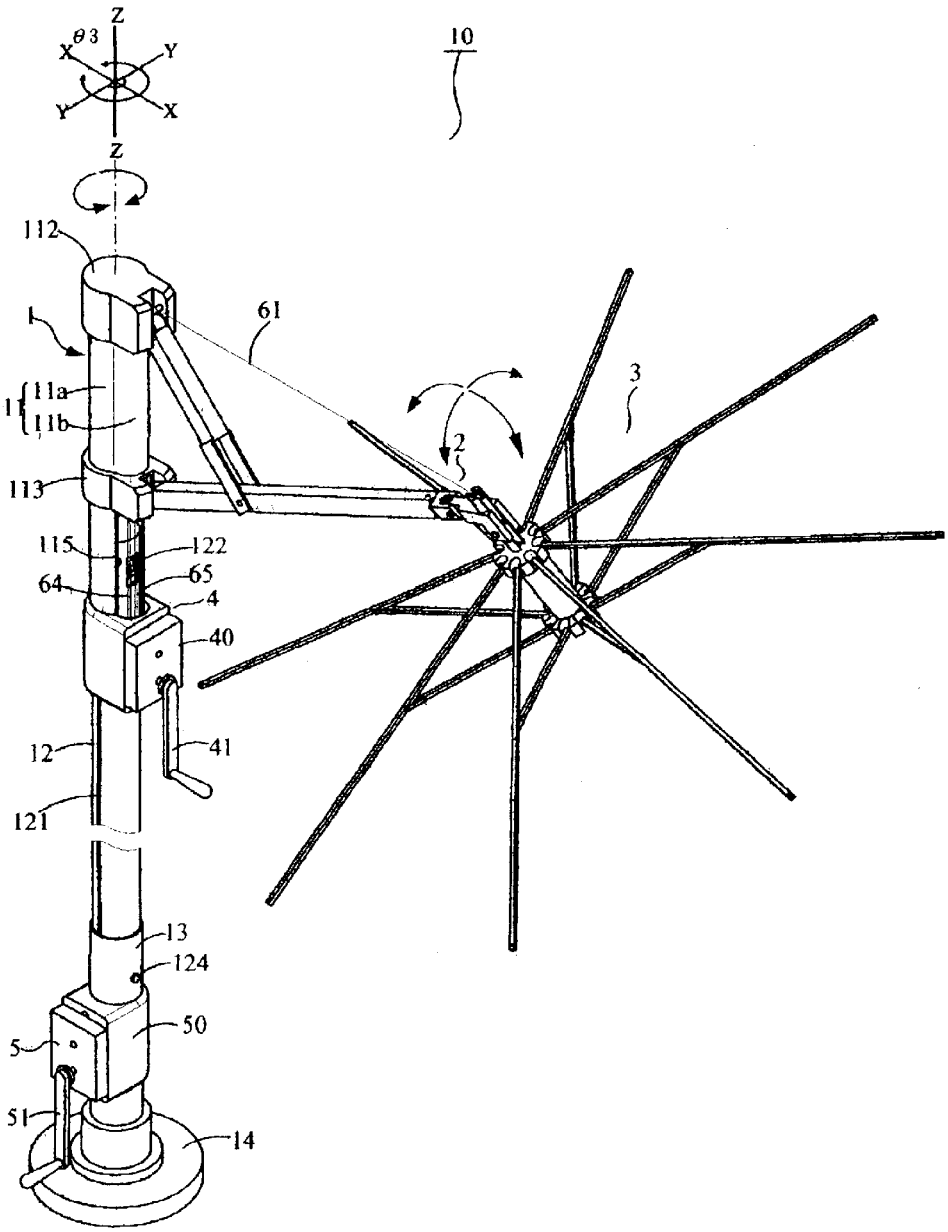
FIG. 10 is a perspective view showing the umbrella frame varying its tilt angle and axial rotational angle.
Figure 11:
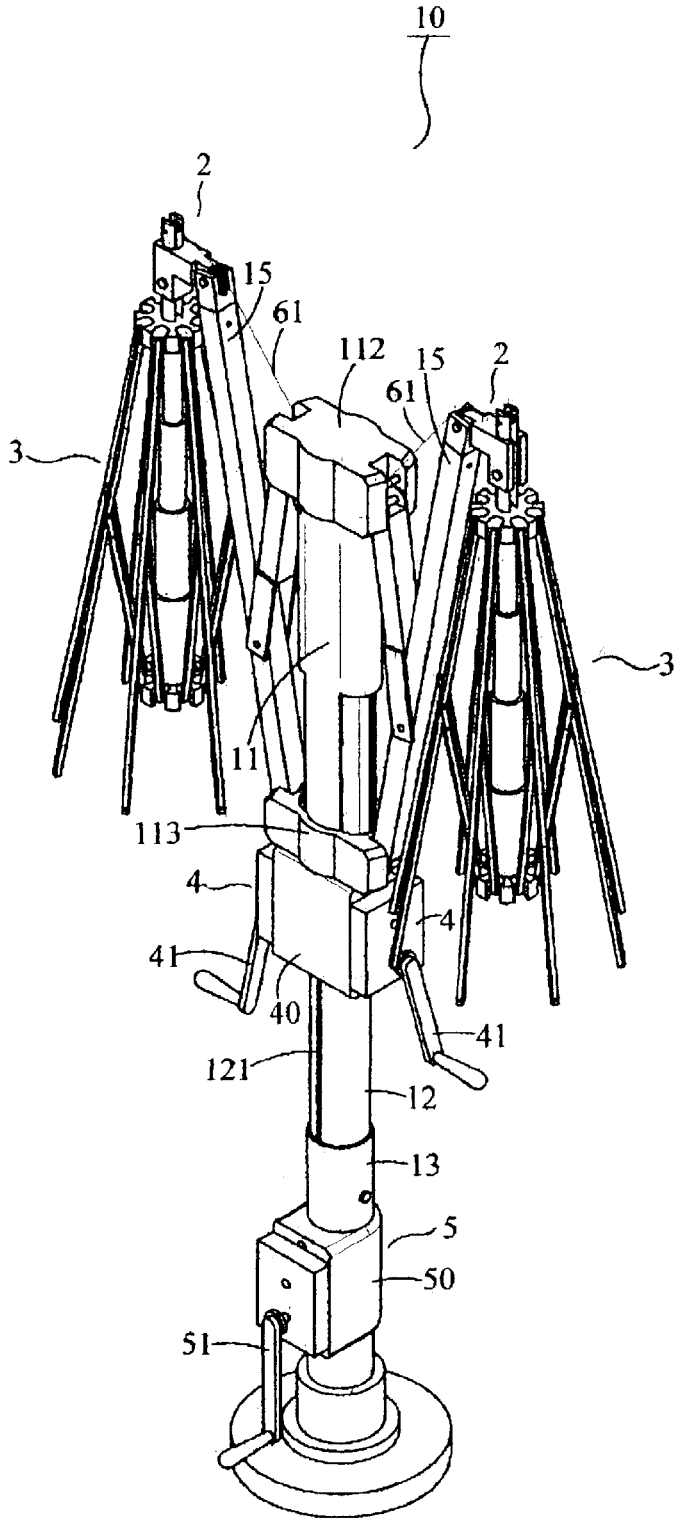
FIG. 11 is a perspective view of another preferred embodiment of the present invention.

FIG. 10 summarizes the angular adjustments of the umbrella frame 3 by the angle-adjusting device 4, the string 64 and string 65. The height-adjustable device 5 further controls the horizontal rotation of the upper tube 11 and the middle tube 12 related to the stationary lower tube 13. The umbrella frame 3 therefore may change its orientation in three angular directions, θ1, θ2, and θ3.

The Second Preferred Embodiment:

A stand frame for an umbrella according to the present invention may is have more than one umbrella frame. FIG. 10 is a preferred embodiment of a stand frame for an umbrella according to the present invention, wherein a stand frame for an umbrella 10 has two umbrella frames 3. To adjust the angular orientation of each umbrella frame 3, the number of angle-adjusting devices 4 should increases accordingly.

Figure 12:
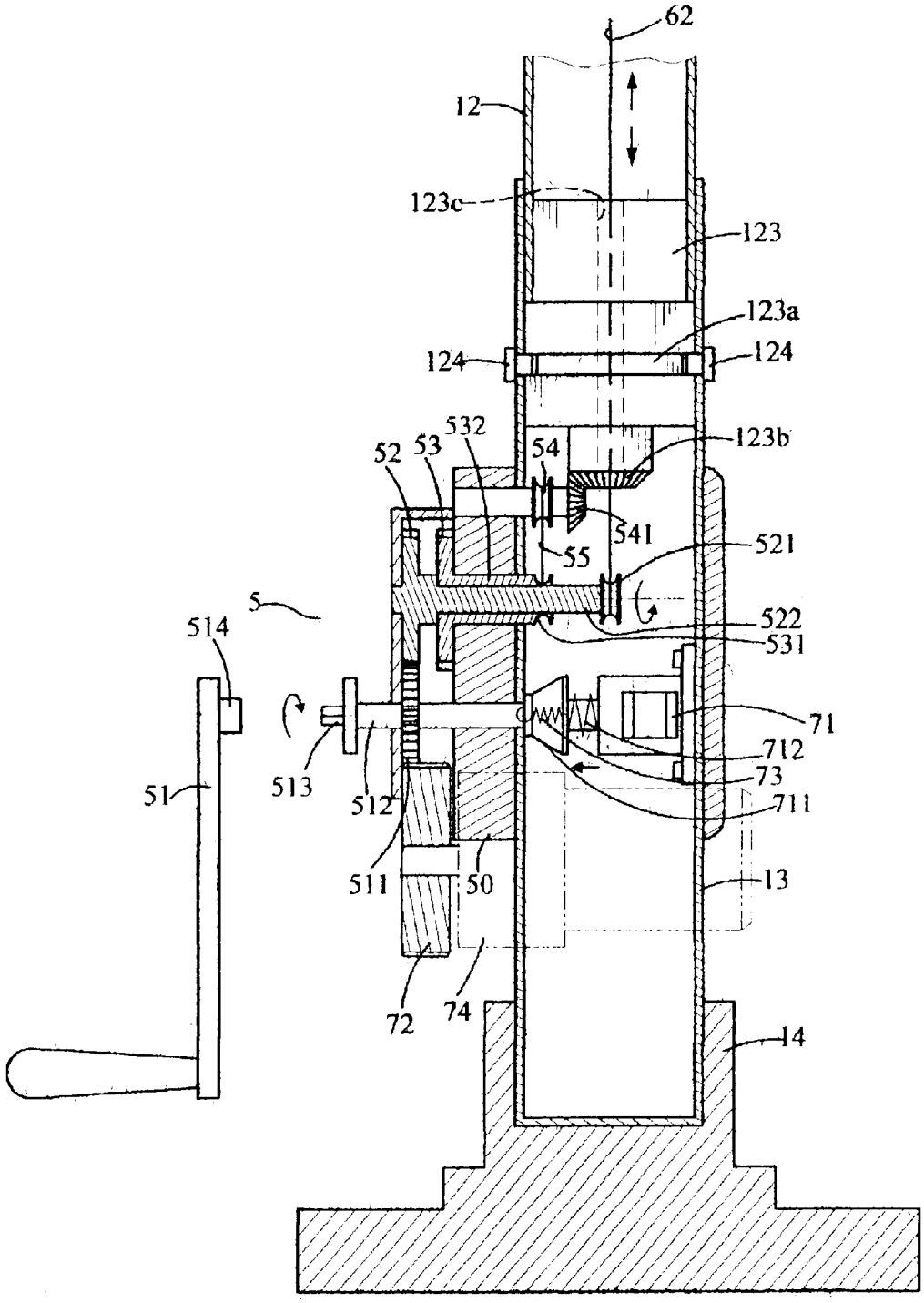
FIG. 12 shows another preferred embodiment of the present invention wherein the height-adjustable device, is electrically powered.
Figure 13:
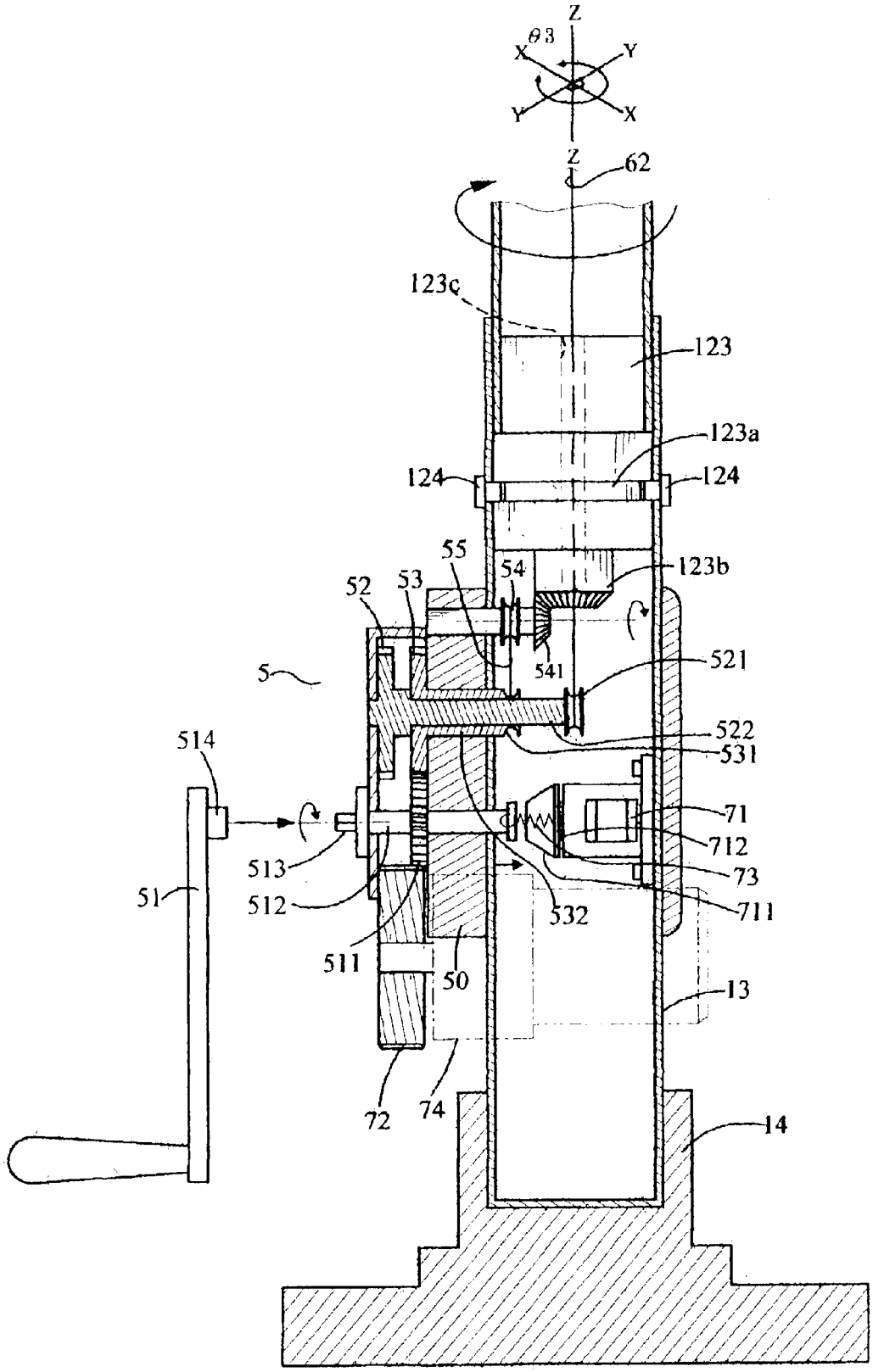
FIG. 13 shows another preferred embodiment of the present invention wherein the height-adjustable device is electrically powered.

The Third Preferred Embodiment:

FIG. 12 is a cross-sectional view of the present invention, wherein the height-adjustable device 5 is electrically powered. Different from the previous embodiments, a stepping motor 74 is mounted underneath the height-adjustable device 5 and on the lower tube 13 at a proper height, in which a main gear wheel 7 is engaged with a gear wheel 511 of the height-adjustable device 5. The end of the rotational axis 512 of the gear wheel 511 is connected to a connector 711 of an electromagnet 71, which is an electromagnetic switch, by a spring 73; the electromagnet 71 is fixed in the lower tube 13. When the electromagnet 71 is not charged, the connector 711 thereof is pushed outward by a spring 712, which pushes the rotational axis 512 outward and makes the gear wheel 511 to engaged with the gear wheel 52. Therefore, the stepping motor 74 can be started to drive the upper tube 11 to move vertically by a coupled rotation between the gear wheel 72, the gear wheel 511, and the gear wheel 52, which causing the umbrella frame 3 to expand or to contract.

Oppositely, a charged electromagnet 71 attracts the connector 711 backward, which pulls the rotational axis 512 inward, assisted by the contraction of the spring 73. As a result, the gear wheel 511 becomes engaged with the gear wheel 53, and the stepping motor 74 can be started to provide a horizontal rotation of the upper tube 11 about the stationary lower tube 13, by the coupled rotation between the electromagnet 71, the gear wheel 511, and the gear wheel 53, which adjusts the horizontal angle θ3.

Further, a square tenon 513 can be mounted at the outer end of the rotational axis 512 for connecting a cranking boar 51 through a sleeve 514, so as to provide an additional manual control of elevating the upper tube 11 and rotating the upper tube 11 and the middle tube 12.

Figure 14:
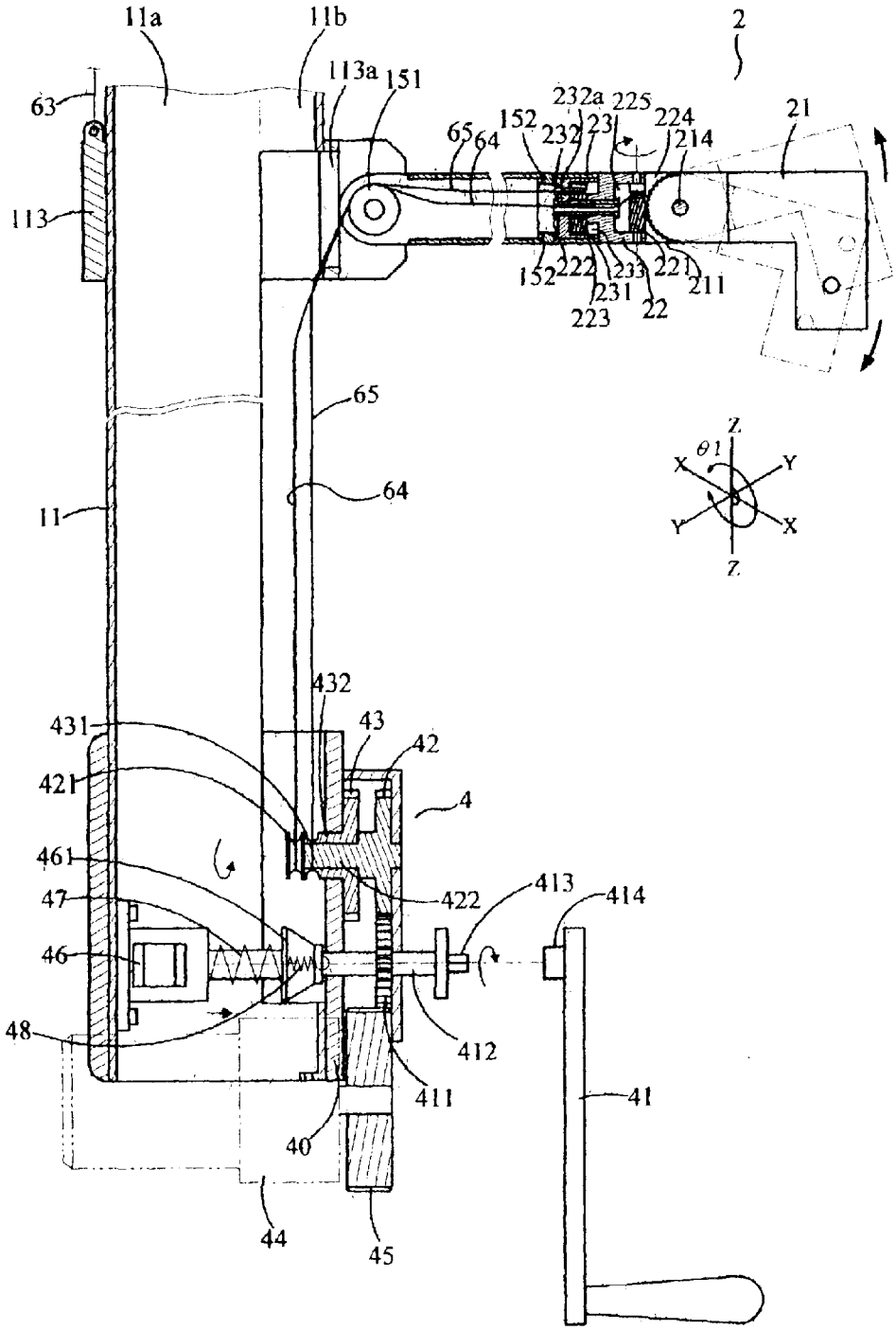
FIG. 14 shows another preferred embodiment of the present invention wherein the angle-adjusting device is electrically powered.

The Fourth Preferred Embodiment:

By the same token, the angle-adjusting device 4 can also be electrically powered, while retaining a manual control mechanism. As shown in FIG. 14, a stepping motor 44 is mounted underneath the angle-adjusting device 4 and on the upper tube 11 at a proper height, in which a main gear wheel 45 is engaged with the gear wheel 411 of the angle-adjusting device 4. The end of the rotational axis 412 of the gear wheel 411 is connected to a connector 461 of an electromagnet 46, which is an electromagnetic switch, by a spring 48; the electromagnet 46 is fixed in the upper tube 11. When the electromagnet 46 is not charged, the connector 461 thereof is pushed outward by a spring 47, which pushes the rotational axis 412 outward and makes the gear wheel 411 to engaged with the gear wheel 42. Therefore, the stepping motor 44 can be started to drive the fixing support 2 to rotate about the axle 222 by a coupled rotation between the main gear wheel 45, the gear wheel 411 and the gear wheel 42 that results in the pulling of the string 65. This achieves adjusting the axial rotational angle θ2.

Figure 15:
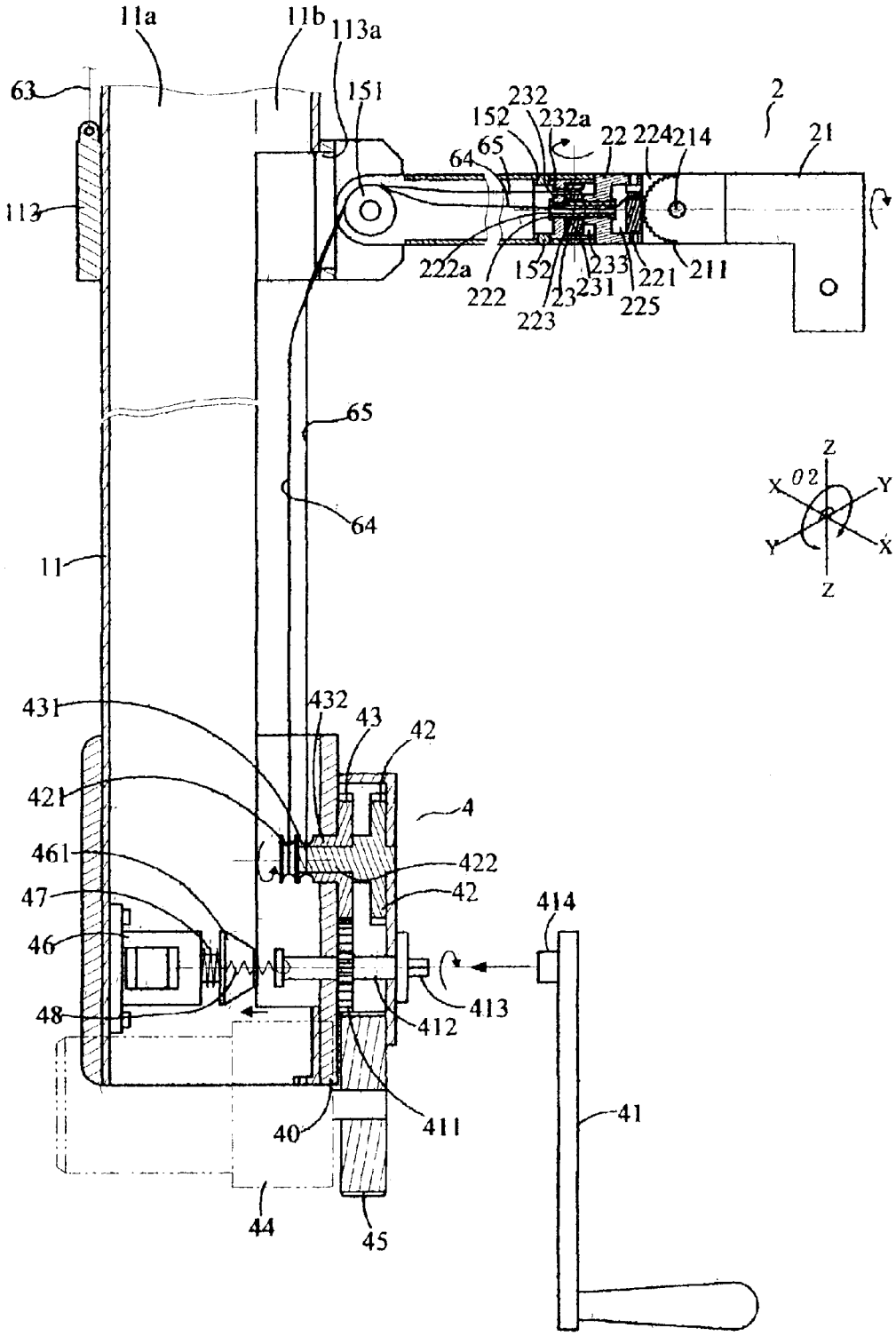
FIG. 15 shows another preferred embodiment of the present invention wherein the angle-adjusting device is electrically powered.

Oppositely, as shown in FIG. 15, a charged electromagnet 46 attracts the connector 461 backward, which pulls the rotational axis 412 inward, assisted by the contraction of the spring 48. As a result, the gear wheel 411 becomes engaged with the gear wheel 43, and the stepping motor 44 can be started to provide a pull of the string 64 that tilts the fixing support 2, by the coupled rotation between the main gear wheel 45, the gear wheel 411, and the gear wheel 43, which adjusts the tilt angle θ1.

Further, a square tenon 413 can be mounted at the outer end of the rotational axis 412 for connecting a cranking bar 41 through a sleeve 414, so as to provide an additional manual control of the tilt angle and the axial rotational angle of the 3.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A stand frame for an umbrella comprising:

a main shaft composed of an upper tube, a middle tube connected to the upper tube, a lower tube, and a connecting sleeve connecting the middle and the lower tubes;

a stand base substantially mounted on a lower end of the lower tube;

a top cover substantially mounted on an upper end of the upper tube;

a height-adjustable device substantially mounted on the lower tube;

a lower sleeve mounted on the upper tube and being capable of sliding thereon;

a long hanger arm pivotally mounted on the lower sleeve;

a short hanger arm with two ends respectively pivotally connected to the top cover and the long hanger arm;

a fixing support including an L-shaped base section, a rotational section, and a connecting section; an axle passing through the rotational section and the connecting section; the connecting section being connected to the long hanger arm;

an umbrella frame composed of an upper hinge disk, a lower hinge disk, a multi-sectional telescopic tube having two ends the upper hinge disk and the lower hinge disk being respectively mounted at, a plurality of main ribs each pivotally connected to the upper hinge disk and a plurality of connecting ribs each with one end pivotally connected to the lower hinge disk and with the other end connected to a main rib;

an umbrella-opening string with one end tied to the top cover, passing around a pulley atop the umbrella frame, through a connecting column, and into the multi-sectional telescopic tube, and with the other tied to the lower hinge disk;

an upper-tube-pulling string partially wound around a windlass in the height-adjustable device on the lower tube, passing around a pulley at an upper end of the middle tube and below a lower end of the upper tube, and being tied at a bottom of the upper tube; and a lower-sleeve-pulling string with one end tied to the lower sleeve, passing around a pulley atop the upper tube and entering the upper tube, and with the other tied at a top of the middle tube; a vertical movement of the upper tube driving a corresponding vertical movement of the lower hinge disk by the lower-sleeve-pulling string, causing the long hanger arm to extend of to contract, which makes the umbrella-opening string to open or to close the umbrella frame.

2. The stand frame for an umbrella of claim 1, wherein a self-closed transmission string is on one side wound around a windlass in the height-adjustable device and on the other side wound around a rotor on a separate axle; a gear wheel being coaxial with the rotor and engaged with a gear wheel underneath a connecting sleeve for driving the middle tube attached thereon to rotate horizontally.

3. The stand frame for an umbrella of claim 2, wherein a stepping motor is mounted under the height-adjustable device; a gear wheel of the stepping motor is engaged with a gear wheel having a rotational axle connected through a compressed spring to a connector of an electromagnet mounted in the lower tube; the rotational axle is shifted longitudinally by magnetic attraction and an extending spring when the electromagnet is charged.

4. The stand frame for an umbrella of claim 2, wherein the connecting sleeve has a ring fillister for receiving a corresponding fixing ring formed at the bottom of the lower tube, thereby preventing the connecting sleeve from coming off the lower tube; a hole is formed at a center of the connecting sleeve for the an upper-tube-pulling string to pass therethrough.

5. The stand frame for an umbrella of claim 2, wherein the height-adjustable device comprises a base mounted on the lower tube, a cranking bar extended from the base, an active gear wheel coaxial with the cranking bar, a first passive gear wheel engaged with the active wheel, a second passive gear wheel coaxial with the first passive gear wheel, a windlass coaxial with the first passive gear wheel, a first rotor integrally mounted on an axis of the second passive gear wheel, a second rotor right above the first rotor with an axis parallel to that of the first rotor, a tapered gear wheel coaxial with the second rotor, and a self-closed transmission string encircling both the first rotor and the second rotor.

6. The stand frame for an umbrella of claim 1, wherein a stepping motor is mounted under the height-adjustable device; a gear wheel of the stepping motor is engaged with a gear wheel having a rotational axle connected through a compressed spring to a connector of an electromagnet mounted in the lower tube; the rotational axle is shifted longitudinally by magnetic attraction and an extending spring when the electromagnet is charged.

7. The stand frame for an umbrella of claim 1, wherein the connecting sleeve has a ring fillister for receiving a corresponding fixing ring formed at the bottom of the lower tube, thereby preventing the connecting sleeve from coming off the lower tube; a hole is formed at a center of the connecting sleeve for the an upper-tube-pulling string to pass therethrough.

8. The stand frame for an umbrella of claim 1, wherein the height-adjustable device comprises a base mounted on the lower tube, a cranking bar extended from the base, an active gear wheel coaxial with the cranking bar, a first passive gear wheel engaged with the active wheel, a second passive gear wheel coaxial with the first passive gear wheel, a windlass coaxial with the first passive gear wheel, a first rotor integrally mounted on an axis of the second passive gear wheel, a second rotor right above the first rotor with an axis parallel to that of the first rotor, a tapered gear wheel coaxial with the second rotor, and a self-closed transmission string encircling both the first rotor and the second rotor.

9. A stand frame for an umbrella comprising:

a main shaft including an upper tube, a middle tube connected to the upper tube, a lower tube, and a connecting sleeve connecting the middle and the lower tubes;

a stand base substantially mounted on a lower end of the lower tube;

a top cover substantially mounted on an upper end of the upper tube;

an angle-adjusting device mounted at the bottom of the upper tube;

a lower sleeve mounted on a section of the upper tube between the top cover and angle-adjusting device;

a long hanger arm pivotally mounted on the lower sleeve;

a short hanger arm with two ends respectively pivotally connected to the top cover and the long hanger arm;

a fixing support mounted at an end of the long hanger arm and including an L-shaped base section, a rotational section, and a connecting section; an axle passing through the rotational section and the connecting section; the connecting section being connected to the long hanger arm;

an umbrella frame having an upper hinge disk, a lower hinge disk, a multi-sectional telescopic tube having two ends the upper hinge disk and the lower hinge disk being respectively mounted at, a plurality of main ribs each pivotally connected to the upper hinge disk and a plurality of connecting ribs each with one end pivotally connected to the lower hinge disk and with the other end connected to a main rib;

a tilt-control string with one end wound around a first rotor in the angle-adjusting device and with another end passing around a pulley in the lower sleeve, entering the long hanger arm, extending to the rotational section of the fixing support, and being wound around a worm therein; the worm turns a semi-circular gear wheel mounted to the L-shaped base section to tilt the umbrella frame.

10. The stand frame for an umbrella of claim 9, further comprising a rotation-control string having one end wound around a second rotor of the angle-adjusting device and having another end passing around the pulley in the lower sleeve, entering the long hanger arm, extending to the connecting section of the fixing support, and being wound around a worm therein; the worm turning a gear wheel integrally mounted on an axle to rotate the umbrella frame.

11. The stand frame for an umbrella of claim 10, wherein a stepping motor is mounted underneath the angle-adjusting device; a gear wheel of the stepping motor is engaged with a gear wheel having a rotational axle which is connected through a compressed spring to a connector of an electromagnet mounted in the middle tube; the rotational axle is shifted longitudinally by magnetic attraction and an extending spring when the electromagnet is charged.

12. The stand frame for an umbrella of claim 10, wherein at least one umbrella frame is used, and each umbrella frame requires an angle-adjusting device.

13. The stand frame for an umbrella of claim 10, wherein the angle-adjusting device comprises a base mounted at an bottom of the upper tube, a cranking, bar extended from the base, an active gear wheel coaxial with the cranking bar, a first passive gear wheel engaged with the active wheel, a second passive gear wheel coaxial with the first passive gear wheel, a first rotor substantially mounted on the first passive gear wheel, a second rotor mounted on the second rotor.

14. The stand frame for an umbrella of claim 10, wherein a cross section of the upper tube is defined by a round portion with a bulged portion; the middle tube is of circular cross section and is contained by the upper tube within the round portion; and the space of the bulged portion can contains three pull strings.

15. The stand frame for an umbrella of claim 9, wherein a stepping motor is mounted underneath the angle-adjusting device; a gear wheel of the stepping motor is engaged with a gear wheel having a rotational axle which is connected through a compressed spring to a connector of an electromagnet mounted in the middle tube; the rotational axle is shifted longitudinally by magnetic attraction and an extending spring when the electromagnet is charged.

16. The stand frame for an umbrella of claim 9, wherein at least one umbrella frame is used, and each umbrella frame requires an angle-adjusting device.

17. The stand frame for an umbrella of claim 9, wherein the angle-adjusting device comprises a base mounted at an bottom of the upper tube, a cranking bar extended from the base, an active gear wheel coaxial with the cranking bar, a first passive gear wheel engaged with the active wheel, a second passive gear wheel coaxial with the first passive gear wheel, a first rotor substantially mounted on the first passive gear wheel, a second rotor mounted on the second rotor.

18. The stand frame for an umbrella of claim 9, wherein a cross section of the upper tube is defined by a round portion with a bulged portion; the middle tube is of circular cross section and is contained by the upper tube within the round portion; and the space of the bulged portion can contains three pull strings.

* * * * *